United States Patent [19]

Kellett

[11] Patent Number: 4,560,317

[45] Date of Patent: Dec. 24, 1985

[54] CRATE CARRYING APPARATUS

[76] Inventor: Robert N. Kellett, P.O. Box 214, Glenorchy, Tasmania, 7010, Australia

[21] Appl. No.: 545,847

[22] Filed: Oct. 27, 1983

[51] Int. Cl.[4] ..... B66F 9/18

[52] U.S. Cl. ..... 414/672; 294/67.1; 294/87.1; 414/785; 414/665; 414/607

[58] Field of Search ..... 414/607, 608, 665, 666, 414/669, 670, 672, 785; 294/67 R, 87 R; 211/59.1

[56] References Cited

U.S. PATENT DOCUMENTS

| | | | |
|---|---|---|---|
| 2,706,062 | 4/1955 | Turner et al. | 414/665 |
| 3,023,919 | 3/1962 | Hobson | 414/785 X |
| 3,529,735 | 9/1970 | Wehde | 414/739 |
| 4,024,972 | 5/1977 | Hobson | 414/607 |
| 4,024,973 | 5/1977 | Siderits et al. | 414/785 X |

FOREIGN PATENT DOCUMENTS

| | | | |
|---|---|---|---|
| 11016 | 8/1971 | Australia . | |
| 40031 | 9/1973 | Australia . | |
| 85470/75 | 5/1975 | Australia . | |
| 2784/79 | 1/1980 | European Pat. Off. . | |
| 1061677 | 12/1939 | Fed. Rep. of Germany . | |
| 1142135 | 1/1963 | Fed. Rep. of Germany . | |
| 512935 | 9/1939 | United Kingdom . | |
| 553207 | 5/1977 | U.S.S.R. | 414/785 |

OTHER PUBLICATIONS

Encyclopedia of Materials Handling, Douglas R. Woodley, 1964, vol. 1.

*Primary Examiner*—Robert J. Spar
*Assistant Examiner*—Ken Muncy
*Attorney, Agent, or Firm*—Larson and Taylor

[57] ABSTRACT

Crate carrying apparatus able to be mounted on a fork lift truck or other lifting device, having at least first and second groups of crate engaging members which can be selectively presented for crate lifting, the engaging members of each group being spaced apart at distances appropriate to the spacing apart of apertures in the crates of a stack of crates of the particular group.

9 Claims, 8 Drawing Figures

CRATE CARRYING APPARATUS

This invention relates to load carrying. In a particular aspect this invention relates to an attachment for fork lift trucks.

There is a need to carry stacks of crates of plastic, wood or metal intended for the purpose of containing bottles and cartons.

However, for certain commodities, the crates may be of one size, whereas, for other commodities, the crates may be of another size.

Those crates normally have apertures in side walls whereby they may be lifted by hand but different crates may have differently sized and differently positioned apertures.

Applicant has noted that while the range of available crates is vast, many enterprises deal with a limited number of different crates, but require to handle stacks of these crates indescriminately.

Accordingly, applicant has sought to provide apparatus which can selectively carry at least two different classes or forms of crate.

The present invention provides crate carrying apparatus comprising a support carried by or adapted to be mounted to a fork lift truck or other lifting means; wherein the support carries a first group of crate engaging means each adapted to enter into a carrying aperture in a crate being a member of a first class of crate, the individual ones of the first group of crate engaging means being spaced apart appropriately to the spacing apart of the apertures in the crates of a stack of crates of the first class of crate and a second group of crate engaging means each adapted to enter into a carrying aperture in a crate being a member of a second class of crate, the individual ones of the second group of crate engaging means being spaced apart appropriately to the spacing apart of the apertures in the crates of a stack of crates of the second class of crate and constructed and arranged such that a selected one of the first and second groups of crate engaging means may be presented for crate lifting.

Preferably, the first and second groups of crate carrying means are moveable between retracted and extended positions whereby the apparatus may present, for crate lifting, a selected one of the first and second groups of crate engaging means.

Preferably, there is first means to which the first group of crate engaging means is mounted and which first means being moveable between positions in which the first group of crate engaging means is retracted and extended as aforesaid.

Preferably this second means to which the second group of crate engaging means is mounted and which second means being moveable between positions in which the second group of crate engaging means is retracted and extended as aforesaid.

The first and second means may be the same or different.

Preferably, the first means and the second means comprise at least one rotatable member.

The invention may also be adapted to selectively present more than two groups of crate engaging means.

The present invention also provides crate carrying apparatus comprising a frame adapted to be mounted to a fork lift truck or other lifting means, a vertically extending member capable of being rotated about a vertical axis, the first group of crate engaging means each adapted to enter into a carrying aperture in a crate being a member of a first class of crates and wherein the individual ones of the first group of crate engaging means are spaced apart of the apertures in the crates of a stack of crates of the first class of crates and a second group of crate engaging means similarly adapted and appropriately spaced as the first group excepting to be in respect of a stack of a second class of crates having carrying apertures differently sized and/or disposed as compared to the first class of crates and wherein the first group and the second group are disposed on the member such that in one and other relatively rotated about said axis position the first group and, respectively, the second can engage with a stack of the crates appropriate thereto without substantial interference by the second group and, respectively the first group.

In general it is preferred that said one and said other relatively rotated positions are at least 90° apart and preferably are about 90° apart. Since the member can be in four relatively rotated positions it may carry four of such groups of crate engaging means but for reasons to become apparent it is preferred that said member has no more than three of such groups of crate engaging means such that said member is able to present a relative rotated position having no such group of crate engaging means about 90° from other relatively rotated positions at which such a group of crate engaging means will be presented.

The frame may carry a number of such members spaced apart appropriately so that each may engage with the crates in a number of stacks of crates which stacks of crates being adjacent to one another.

The individual ones of said number of such members may be individually rotated as is desired about their vertical axes; alternatively, means may be provided for rotating them about their vertical axes as a group. Such means may include chain and sprocket means or lever means or a pully mechanism.

In general, two types of crates predominate; one type has one such aperture centrally located along the length of a side wall and the other type has two such apertures generally equidistantly located about the centre of the length of a side wall. To deal with said other type one might provide one such member with two such crate engaging means for each crate. However, it is considered best that there is at least one group of three such members and that the middle one of each group of three is used in respect of said one type and the outside two of each group of three is used in respect of said other type.

Thus, considering that said middle one of each group may reasonably carry three groups of crate engaging means and said outside two of each group may also reasonably carry three groups of crate engaging means it will be realized that the apparatus of the present invention may be used to carry six classes of crates. In practice, however, the ability to carry two classes of crates will be satisfactory.

A specific construction of apparatus in accordance with this invention will now be described with the aid of the accompanying drawings, in which.

Figures 1, 2:
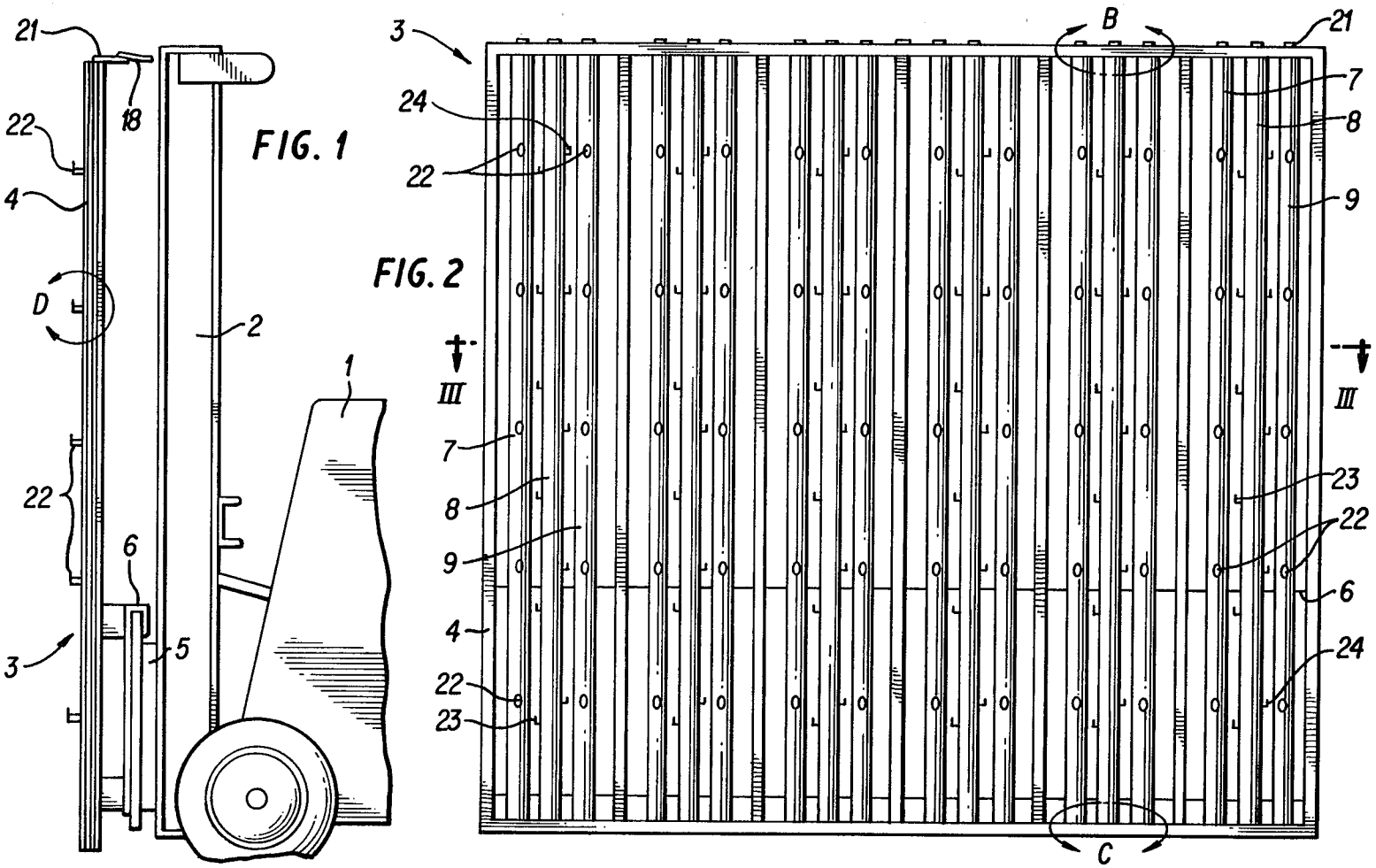
FIG. 1 is a side elevation of a fork lift truck to which the apparatus if fitted.
FIG. 2 is a front elevation of the apparatus.
Figure 3:
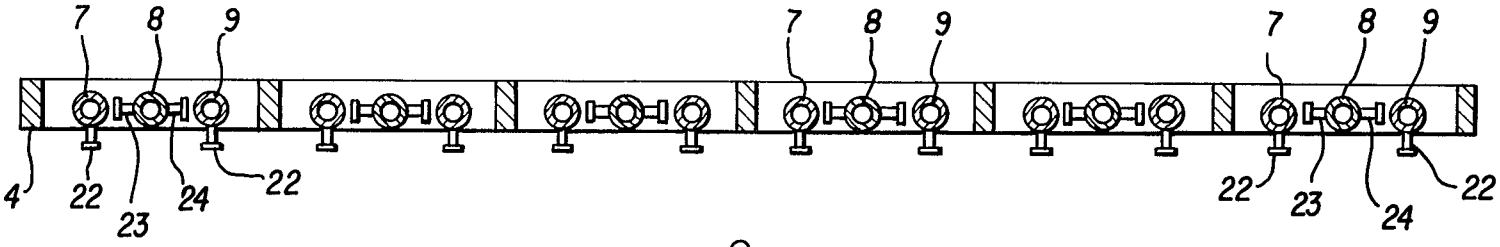
FIG. 3 is a cross-section on line III—III of FIG. 2.
Figure 8:
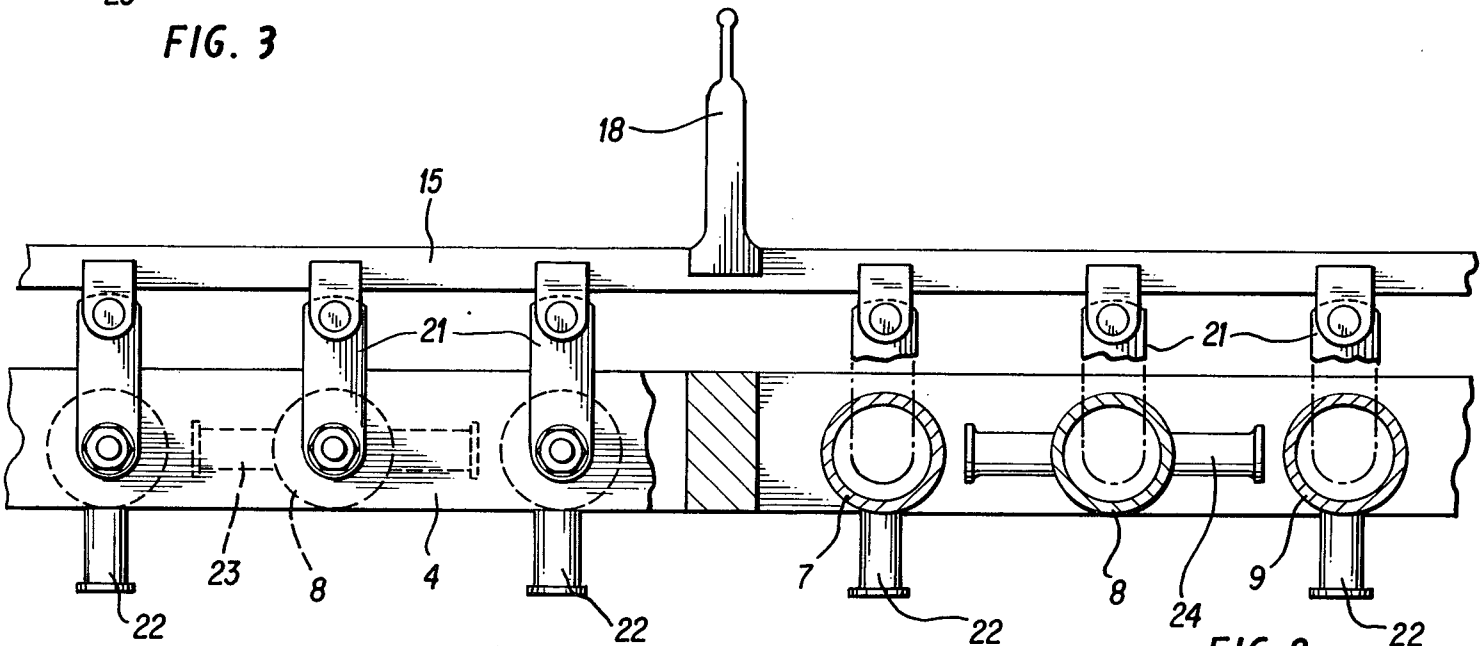
FIG. 8 is a fragmentary top plan view.
Figure 5:
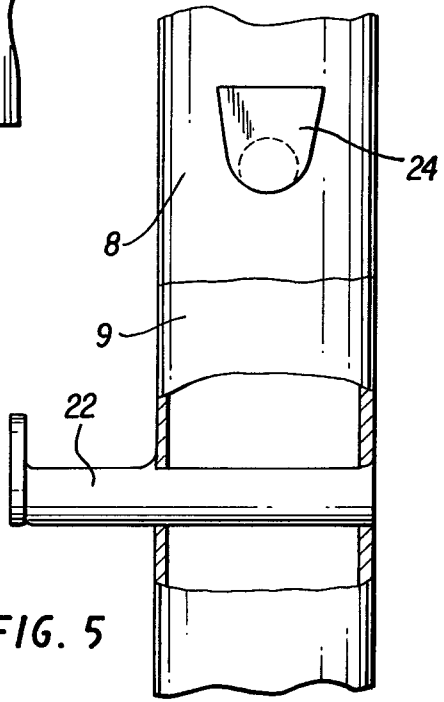
FIG. 5 is a detail of a region labelled "D" in FIG. 1.
Figure 4:
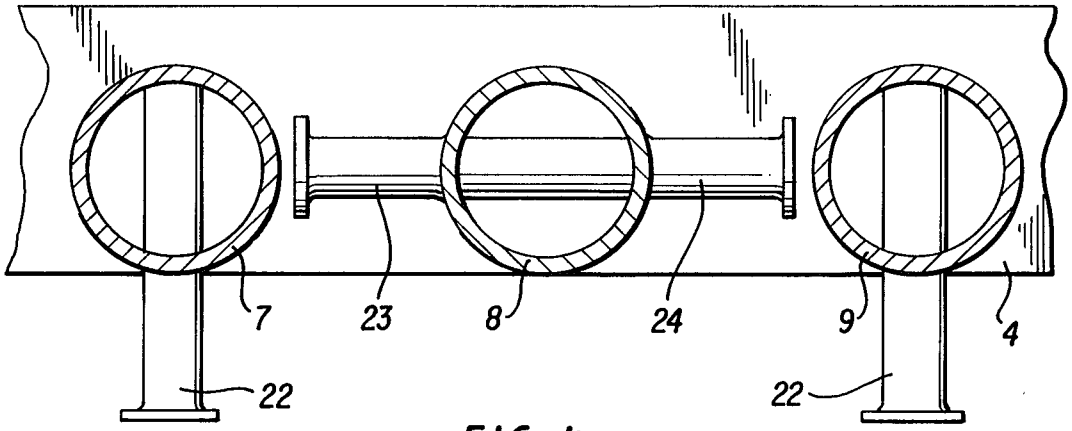
FIG. 4 is a detail of a region labelled "A" in FIG. 3.
Figure 7:
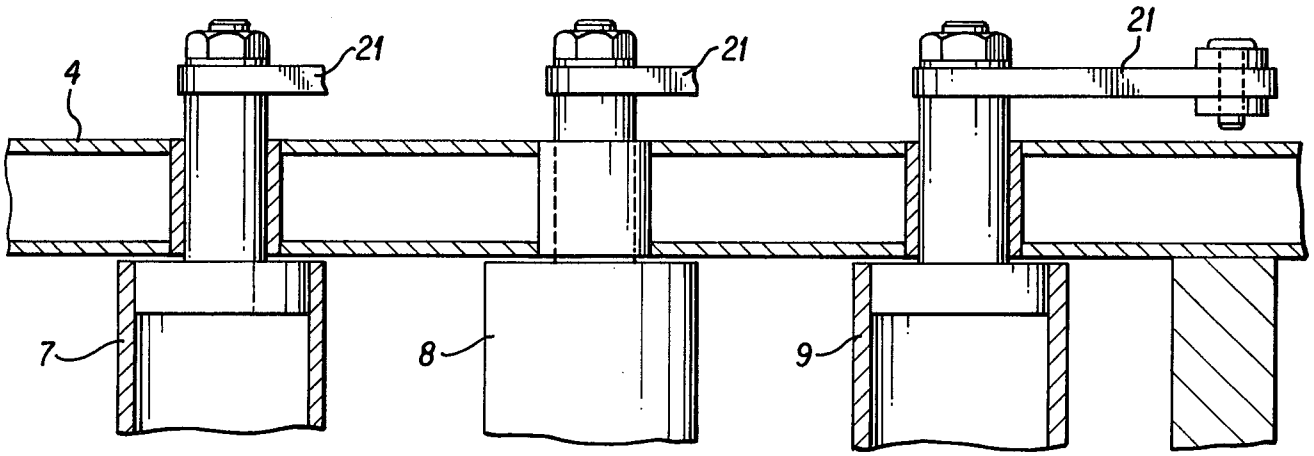
FIG. 7 is a detail of a region labelled "B" in FIG. 2.
Figure 6:
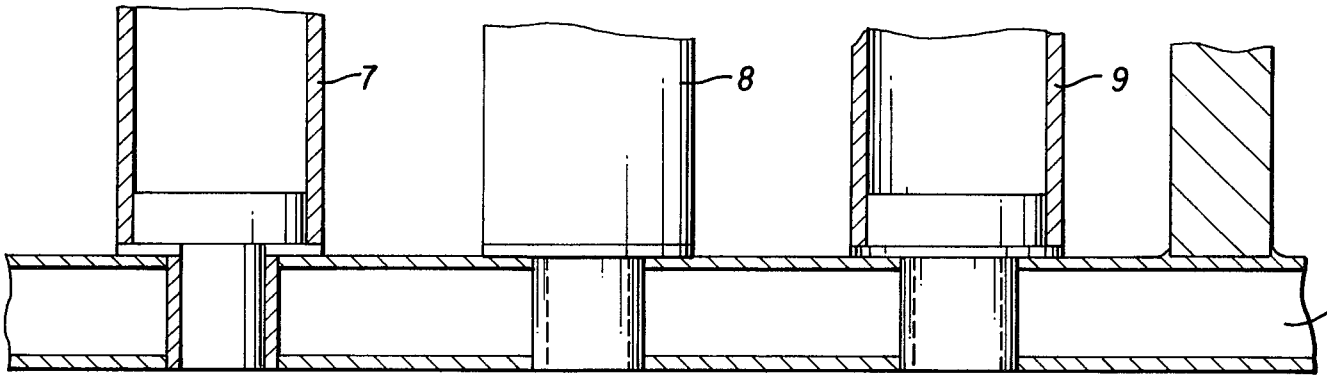
FIG. 6 is a detail of a region labelled "C" in FIG. 2.

In the drawings the fork lift truck 1 has a mast 2, a carriage 5 vertically moveable on the mast 2 and the apparatus of the invention is generally indicated by 3.

The apparatus of the invention includes a frame 4, means 6 for attaching the apparatus to the carriage 5 and six groups of three vertically extending members (7, 8 and 9). The members 7, 8 and 9 are journalled to the frame 4 to be rotatable about vertical axes. Links 21 are attached to the members 7, 8 and 9 and tie rod 15 and lever means 18 is provided to rotate all of the members 7, 8 and 9 together.

The members 7 and 9 each carry hooks 22 for engaging with a crate of the type having two carry holes in a side wall. The hooks 22 are shaped and are vertically spaced along the members 7 and 9 to suit the holes in, and the height of the crates. The members 8 each carry hooks 23 and 24 for engaging with crates of the type having one carrying hole in the side wall. The hooks 23 are shaped and are vertically spaced along the members 8 to suit the holes in, and the height of one class of crates and the hooks 24 are shaped and vertically spaced along the members 8 to suit the holes in, and the height of another class of crates.

By moving the lever means 15, the selected one of the hooks 22, 23 and 24 can be made to project forward.

Accordingly, the apparatus as described above can be used to carry three classes of crates.

The above apparatus may be modified if desired such as if only one class of crate is desired to be picked up the apparatus may have all fixed hooks that do not rotate and if only two classes of crates are to be picked up there may be one group of hooks on one side and another on the opposite side and the apparatus may be such as to be mounted to the fork lift truck to present the one or another group as desired.

Alternatively, if only two classes of crates are to be picked up there may only need to be two types of rotating vertically extending members or even only one type of rotating vertically extending member, depending on the nature of the crates to be picked up.

I claim:

1. Crate carrying apparatus comprising a support carried by or adapted to be mounted to a truck lifting means, a first group of crate engaging means mounted on the support and each adapted to enter into a carrying aperture in a crate of a first class of crate, individual engaging means of the first group of crate engaging means being spaced apart an amount related to the spacing apart of the apertures in the crates of a stack of crates of the first class of crates, a second group of crate engaging means mounted on the support and each adapted to enter into a carrying aperture in a crate of a second class of crates, individual crate engaging means of the second group of crate engaging means being spaced apart an amount related to the spacing apart of the apertures in the crates of a stack of crates of the second class of crates and means for enabling one or the other of the first and second groups of crates engaging means to be selectively presented for crate lifting.

2. Crate carrying apparatus as claimed in claim 1, wherein said means for enabling the first and second groups of crate carrying means to be selectively presented comprises means for permitting movement of said first and second groups of crate carrying means between retracted and extended positions whereby the apparatus can present a selected one of the first and second groups of crate engaging means for crate lifting.

3. Crate carrying apparatus as claimed in claim 2, wherein said movement permitting means comprises first means to which the first group of crate engaging means is mounted and which is moveable to provide movement of the first group of crate engaging means between said retracted and extended positions.

4. Crate carrying apparatus as claimed in claim 3 wherein said movement permitting means further comprises second means to which the second group of crate engaging means is mounted and which is moveable to provide movement of the second group of crate engaging means between said retracted and extended positions.

5. Crate carrying apparatus as claimed in claim 2 wherein said movement permitting means comprises a single means to which the first and second groups of crate engaging means are mounted and which provides movement of said first and second groups of crate engaging means between said retracted and extended positions in alternative relationship to each other whereby said first group is in the extended position thereof when said second group is the retracted position thereof and vice versa.

6. Crate carrying apparatus as claimed in claim 3, wherein said first means comprises at least one rotatable member.

7. Crate carrying apparatus as claimed in claim 4, wherein said second means comprises at least one rotary member.

8. Crate carrying apparatus as claimed in claim 5, wherein said single means comprises at least one rotatable member.

9. Crate carrying apparatus comprising a frame adapted to be mounted on a truck lifting means, a vertically extending member capable of being rotated about a vertical axis, a first group of crate engaging means mounted on said vertically extending member, each of said first group of crate engaging means being adapted to enter into a carrying aperture in a crate of a first class of crates and individual crate engaging means of the first group of crate engaging means being spaced apart along said member an amount related to the spacing apart of the apertures in the crates of a stack of crates of the first class of crates, and a second group of crate engaging means mounted on said vertically extending member, each of said second group of crate engaging means being adapted to enter into a carrying aperture in a crate of a second class of crates, and individual crate engaging means of the second group of grate engaging means being spaced apart along said member an amount related to the spacing apart of the apertures in the crates in a stack of crates of the second class of crates, the spacing between the crate engaging means of said first group being different from the spacing between the crate engaging means of said second group, said first group and said second group being disposed on the vertically extending member such that in a first rotational position of the vertically extending member the first group of crate engaging means is presented for engaging a stack of crates of the first class and in a second rotational position of the vertically extending member the second group of crate engaging means is presented for engaging a stack of crates of the second class.

* * * * *